US006240686B1

(12) United States Patent
Mill

(10) Patent No.: US 6,240,686 B1
(45) Date of Patent: Jun. 5, 2001

(54) PRESTRESSED UNITARY BUILDING METHOD AND STRUCTURE

(76) Inventor: Donald R. Mill, 875 Ocean Ave., Point Richmond, CA (US) 94801

( * ) Notice: Subject to any disclaimer, the term of this patent is extended or adjusted under 35 U.S.C. 154(b) by 0 days.

(21) Appl. No.: 09/233,225

(22) Filed: Jan. 19, 1999

(51) Int. Cl.[7] ..... E04B 1/32

(52) U.S. Cl. ..... 52/223.1; 52/89; 52/23; 52/745.08; 52/741.12

(58) Field of Search ..... 52/86, 88, 89, 52/63, 81.6, 3–5, 23, 2.25, 2.24, 222, 223.1, 644, 745.05–745.08, 741.14, 745.2

(56) References Cited

U.S. PATENT DOCUMENTS

| | | | | |
|---|---|---|---|---|
| 862,418 | * | 8/1907 | Street | 52/89 X |
| 2,328,197 | * | 8/1943 | Cowin | 52/86 |
| 3,088,558 | | 5/1963 | Dickinson . | |
| 3,464,168 | | 9/1969 | Russell et al. . | |
| 3,715,843 | * | 2/1973 | Ballinger | 52/3 |
| 4,071,985 | * | 2/1978 | Wickwire | 52/86 |
| 4,084,358 | * | 4/1978 | Winters | 52/4 |
| 4,094,110 | | 6/1978 | Dickens et al. . | |
| 4,397,122 | * | 8/1983 | Cros | 52/3 |
| 4,745,713 | * | 5/1988 | Gotoh | 52/89 |
| 4,763,452 | * | 8/1988 | Harvey | 52/222 |
| 4,907,383 | * | 3/1990 | Winter, IV | 52/86 |
| 5,069,015 | * | 12/1991 | Steinwender | 52/89 X |
| 5,323,573 | | 6/1994 | Bakewell, III . | |
| 5,408,793 | * | 4/1995 | Dykmans | 52/81.6 |
| 5,791,090 | * | 8/1998 | Gitlin et al. | 52/4 |

* cited by examiner

*Primary Examiner*—Carl D. Friedman
*Assistant Examiner*—Winnie Yip
(74) *Attorney, Agent, or Firm*—Harris Zimmerman

(57) ABSTRACT

A method and structure for forming a small building includes a continuous curved wall forming a semi-arcuate arch, the wall comprised of lightweight cellular material such as foamed blocks. The blocks may be identical and interchangeably secured in place by adhesive to form the wall, so that the arch is easily constructed. The arched wall comprises both the longitudinal sides and the top of the structure. In addition, the structure includes an outer skin which covers the entire exterior of the arched wall. The outer skin is both a weatherproof layer and a tension member to apply a compressive force uniformly to the outer surface of the arched wall and significantly augment the load strength of the arch, resulting in a structure that is made very strong with a minimum mass of material. The method of the invention includes the steps of providing a plurality of cellular blocks of expanded foam plastic or the like, each block defining an angular increment of an arched wall and having a length that is an incremental portion of the length of the arched wall. Courses of blocks are laid in laterally spaced arrangement and adhered in place until the arched wall is completed. Alternatively, incremental arches may be constructed horizontally and tilted upwardly into abutting, adjacent relationship. Thereafter, an outer skin is formed over the exterior surface of the arched wall and tensioned to compress the arched wall.

18 Claims, 5 Drawing Sheets

PRESTRESSED UNITARY BUILDING METHOD AND STRUCTURE

BACKGROUND OF THE INVENTION

The impetus for mankind to create buildings is likely traceable to the original desire for more comfortable domiciles. Throughout millennia and around the world, various peoples have used indigenous materials to create shelters that resist the elements and provide warmth, space, and protection. The variety of materials used for this general purpose range widely, from bamboo poles and palm thatch to stone and adobe brick, animal skins and snow blocks, logs and oakum, lumber, concrete, steel and glass.

Despite the diversity of building material that have been used, the general approach to designing buildings has remained remarkably similar throughout the cultures and peoples of the world. Generally speaking, domiciles and other buildings are constructed of load-bearing walls that support a sheltering roof. If this concept is extended, the floor may be supported by the bearing walls to be spaced above the ground, and more than one floor may be provided in vertically spaced relationship, also supported by the load-bearing walls. Exceptions include the Inuit igloo, built of snow blocks in a dome shape, and the teepee of the plains Indians, but these structures are at or below grade level and cannot be extended upwardly.

The general approach for construction of a home or similar small building has evolved into a standard procedure. First a framework for load-bearing walls is constructed on a suitable foundation, then a framework for the floor(s) is added, as well as a framework for a roof. An exterior surface is added to the walls framework, a roof is added above, insulation is added to the walls, flooring is placed on the interior framework, and interior finish work is applied to create amenities for the interior rooms. That is, first the mechanical structure is created, and then the remaining parts of the building are hung on the structure to form the finished construction.

This approach to building tends to view each building sub-system as a separate entity with a function that is not directly related to the other sub-systems. For example, exterior siding is not considered to be a structural reinforcing element, nor is the insulation utilized in a way that would augment the load-bearing strength of the walls. In this piecemeal approach, the sub-systems are not synergistic. In addition, this standard approach to building construction requires a large amount of skilled labor from several distinct trade groups: carpenters, plasterers and sheetrock workers, and roofers. In general, the amount of skilled labor required, together with the sub-system approach to construction, has resulted in home construction and small building construction in general being expensive. These factors have priced home ownership beyond the reach of too many persons, particularly outside the developed, industrialized countries of the world.

One approach to overcoming these obstacles to inexpensive homes and buildings has been the creation of modular buildings manufactured in mass production and transported to a construction site. Generally speaking, these modular arrangements continue to rely on the traditional approach to construction, including load-bearing walls to support the floor(s) and roof, and each sub-system remains a separate entity in a functional sense. However, each module incorporates portions of each building sub-system, which are joined at the construction site to form a traditional construction. The advantage in cost is due to mass production, not to structural innovation, and there is a penalty to be paid in enforced uniformity in building design.

There have been many modern innovations in structural design and materials, but these innovations have not been widely adopted. The Quonset hut of W.W.II exploited the inherent strength of an arch to form a shelter of relatively thin sheet metal and no other supporting structure, and was cheap, portable, and easy to construct. However, the noisiness of the bare sheet metal and the lack of thermal insulation prevented its widespread use beyond temporary military buildings. Likewise, the development of tensegrity principles by Buckminster Fuller and their application to geodesic domes resulted in a few structures of renown, some military uses (radomes), and virtually no ongoing commercial success. New materials such as structural foamed plastics have been applied most notably as shear connectors in sandwich panels for aircraft wing construction, by Bert Rutan and others, and there is an active and growing interest in applications of structural insulated panels.

There remains in the prior art an unmet need for a inexpensive, practical approach to building a home or small building that is durable, comfortable and easy to construct.

SUMMARY OF THE INVENTION

The present invention generally comprises a method and structure for forming a practical, inexpensive small building for housing and other purposes. A salient aspect of the building is that the components are structurally integrated and interactive, and the structure is strong, easily built, comfortable and practical.

In one aspect, the structure of the invention comprises a continuous curved wall forming a semi-arcuate arch, and the wall is comprised of lightweight cellular material such as foamed plastic (expanded polystyrene or the like) blocks or bricks formed as curved sections of the arch. The blocks may be identical and interchangeably secured in place by adhesive or the like to form the wall, so that the arch is easily constructed. The arched wall is a convex structure defining a sheltered space thereunder, and comprises both the longitudinal sides and the top of the structure.

In addition, the structure includes an outer skin of sheet metal, tensile plastic, or the like which covers the entire convex exterior of the arched wall. The outer skin provides resistance to weather elements, and serves the purpose of a roof and wall siding. More importantly, the outer skin is anchored to the foundation of the arched wall, and is placed under tension at each anchor, whereby the outer skin applies a compressive force uniformly to the outer surface of the arched wall. The compressive force significantly augments the inherent strength of the arch, resulting in a structure that is made very strong with a minimum mass of material. Thus the compressed arched wall may support expected snow loads, as well as wind and seismic shear, ice, and the like.

The method of the invention includes the steps of providing a plurality of cellular blocks of expanded foam plastic or the like, each block defining an angular increment of an arched wall and having a length that is an incremental portion of the length of the arched wall. A foundation may be constructed; e.g., a pair of longitudinally extending footings that are laterally spaced to support the opposed lower edges of the arched wall. A course of blocks is then placed on each footing and adhered in place. Second courses of blocks are placed atop the first rows and adhered in place, and this process is reiterated, including the use of temporary bracing to support the developing arches extending upwardly and converging from each footing. This procedure is reiterated until the arched wall is completed.

Thereafter, an outer skin is formed over the exterior surface of the arched wall. The outer skin may comprise a unitary tensile sheet, or a plurality of strips of sheet metal, tensile plastic or the like, each strip having a width preferably equal to a plurality of blocks and a length equal to the peripheral extent of the arch.. The tensile sheet or strips are placed circumferentially about the arched wall, extending in a plane generally perpendicular to the axis of symmetry of the arched wall. The strips may overlap slightly and be sealed therebetween to form a waterproof assembly.

The lower ends of each strip are anchored to the respective adjacent footing, and thereafter placed under tension to draw the strip compressively about the underlying portion of the arched wall. This procedure is reiterated for all the strips, thereby placing the entire arched wall under compression and forming a strong, lightweight composite structure. End walls including windows and doors are then constructed at the opposed open ends of the arched wall to form an enclosed building. The interior may then be finished with walls, cabinets, fixtures, plumbing and electrical systems, HVAC, plumbing, plastering, and the like. The cellular blocks may be formed of fire retardant materials, and/or the interior surface of the arched wall may have a fire retardant material applied thereto by painting, spraying, or the like.

It may be noted that the cellular blocks comprise not only structural elements of the arched wall, but also substantial insulation for thermal and acoustic purposes. Likewise, the outer strips comprise not only a weatherproof exterior, but also a structural element for placing the arched wall under permanent compression to increase its strength and stiffness and provide dimensional stability with respect to temperature changes. In addition, the footings support the arched wall and also provide tensioning anchors for the exterior strips, Thus the entire structure is a well-integrated, synergistic assembly.

DESCRIPTION OF THE PREFERRED EMBODIMENT

Figure 1:
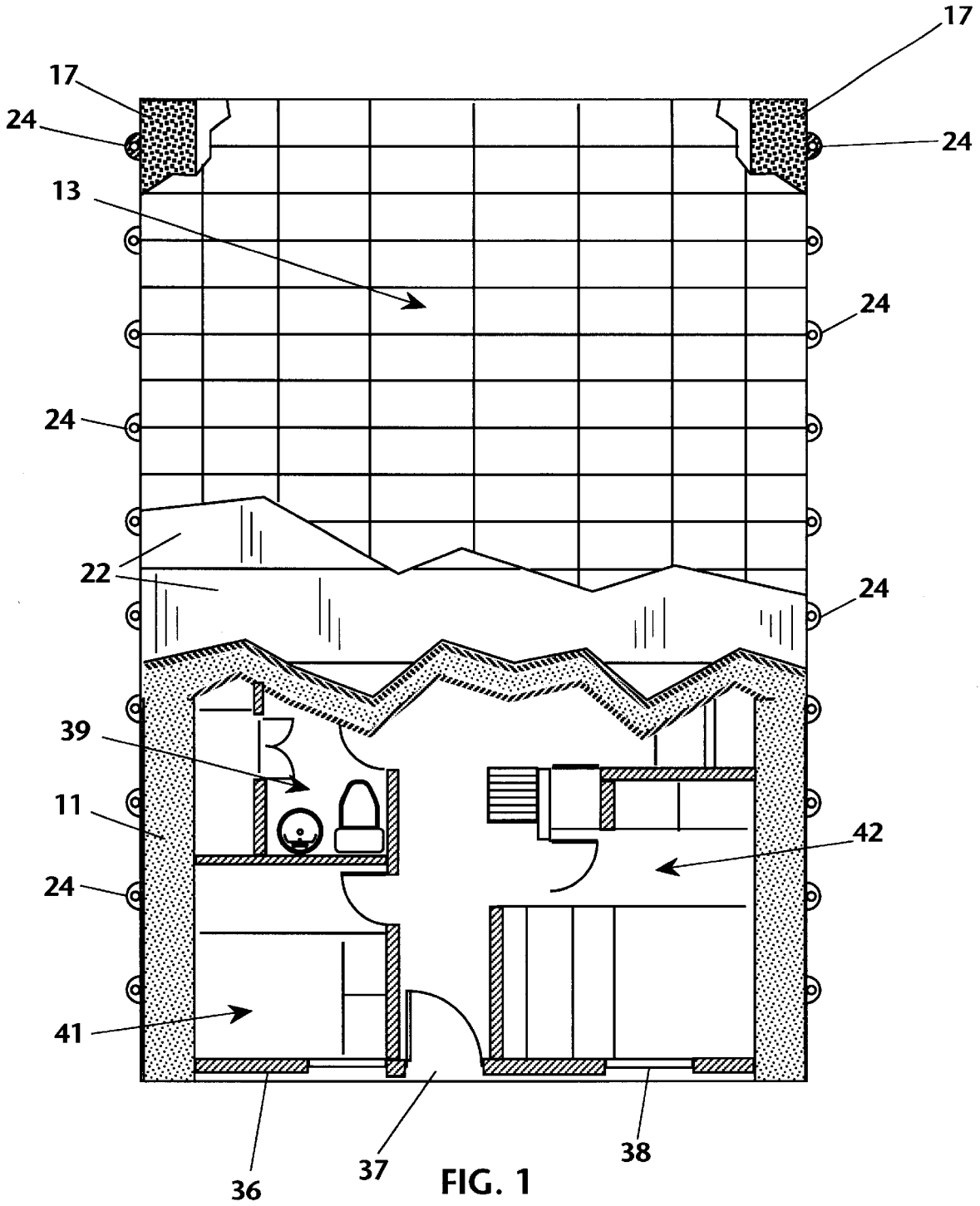
FIG. 1 is a partially cutaway plan view of the prestressed unitary building construction of the present invention.
Figure 2:
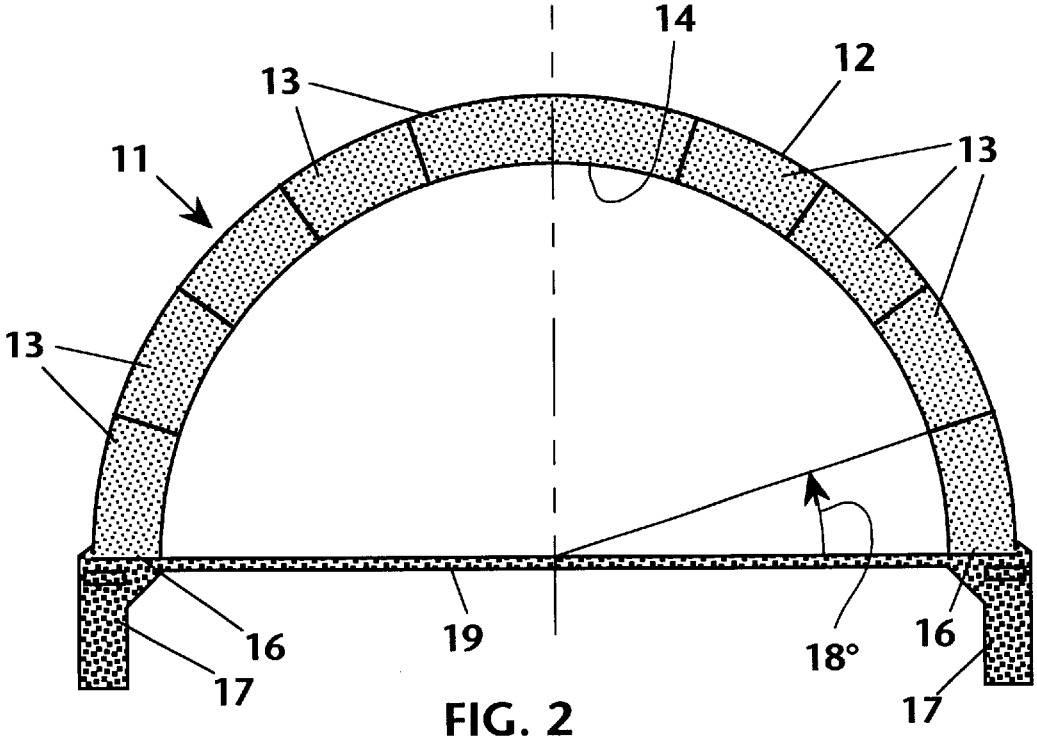
FIG. 2 is a cross-sectional end view of the prestressed unitary building construction shown in FIG. 1.
Figure 3:
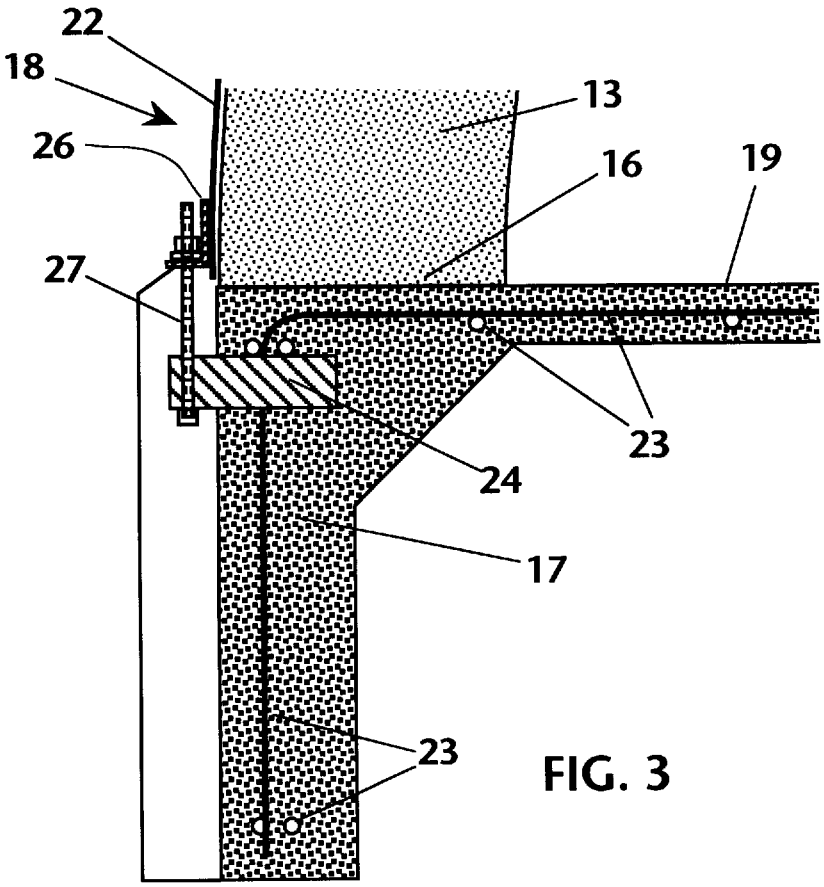
FIG. 3 is an enlarged partial cross-sectional end view of a tension anchor assembly of the prestressed unitary building construction of FIGS. 1 and 2.

The present invention generally comprises a method and structure for forming a practical, inexpensive small building for housing and other purposes. With reference to FIGS. 1–3, one aspect of the structure of the invention includes a continuous curved wall 11 forming a semi-arcuate vault or arch 12. The arch 12 may be semi-cylindrical, as shown, or other regular curves such as conic sections or irregular curves of demonstrated architectural strength. The wall 11 is formed of a plurality of blocks 13 or bricks of lightweight cellular composition, such as foamed plastic (expanded polystyrene or the like), or a compressed and bonded cellular material (Perlite™ or the like), or a composite material incorporating such materials. An important characteristic of the block material is that it is lightweight and possesses excellent thermal insulation properties and compression strength at least as good as expanded polystyrene.

The blocks 13 are preferably identical, each block subtending a small increment of the total included angle of the arch 12 and comprising a small incremental portion of the length of the wall 11. Each block 13 is preferably small enough to be carried and manipulated by one person. For example only, in a preferred embodiment the interior surface 14 of the arch 12 has a radial dimension of 11 feet, and each block subtends an angle of 18° and extends lengthwise 1 foot, 10 inches. The blocks may be abutted and joined with a layer of adhesive.

Figure 6:
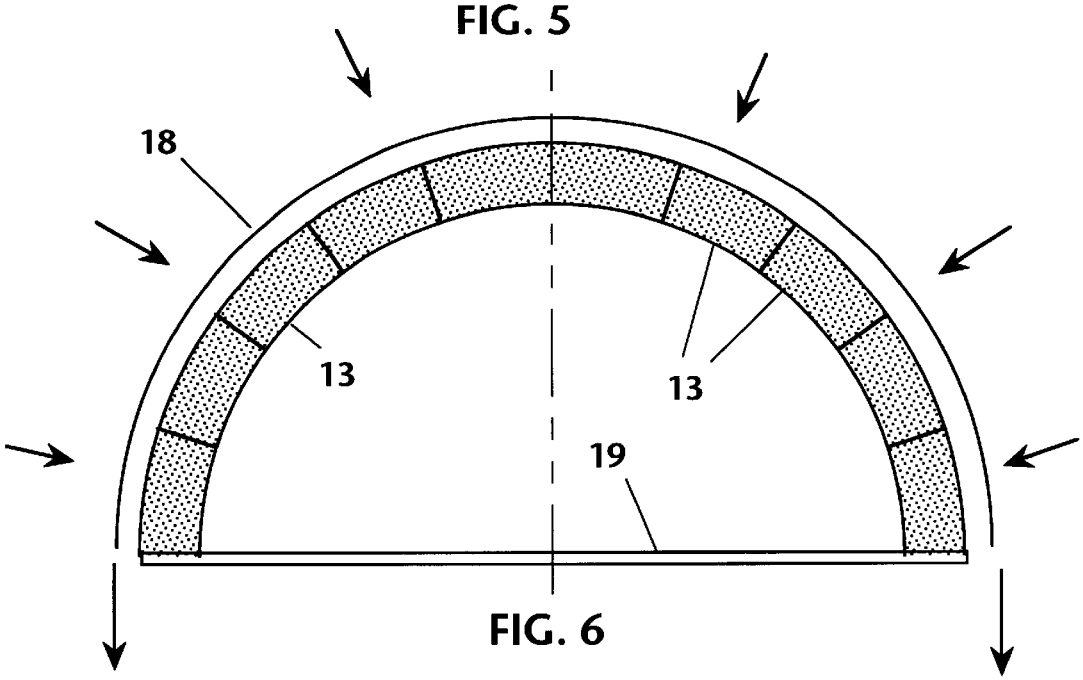
FIG. 6 is an end elevation as in FIGS. 4 and 5, depicting the installation of the tensioned outer skin to compress the arched wall of the prestressed unitary building of the invention.

With regard to FIGS. 1 and 3, the wall 11 includes lower edge portions 16 that are laterally opposed and longitudinally extending, each lower edge portion 16 impinging on a ground surface or preferably on a foundation footing wall 17. A floor surface 19 may be provided to form a finished interior space. A salient aspect of the structure is the provision of an outer skin 18 extending about the exterior surface of the arch 12 between the lower edge portions 16 and extending the length of the wall 11. In particular, the outer skin 18 is placed under tension in downward, tangential direction at the lower edge portions 16 to draw the outer skin 18 about the arched wall and exert a compressive force on the wall and all the blocks, as shown in FIG. 6. The compressive force may be on the order of 3–5 psi for a typical expanded plastic, and may be higher for other materials. The compressive force is directed radially, and greatly enhances the load-bearing strength of the arch 12. The outer skin 18 may comprise a plurality of flexible sheet panels 22 extending circumferentially in an arc generally coaxial with the arch 12, and may be formed of sheet metal, tensile plastic composites, or the like. The outer skin 18 enables the arch 12 to support large loads in both vertical and lateral directions, and at the same time the outer skin serves as a weatherproof roof and outer siding to protect the building.

With regard to FIG. 3, the floor 19 and footings 17 may be cast of structural concrete reinforced with standard rebar members 23, as is commonplace in the prior art. One mechanism for tensioning the outer skin 18 includes the placement of a plurality of anchor blocks 24 cast within the footings 17, the anchor blocks being spaced apart longitudinally along the footings 17. (See also FIG. 1.) Joined to each lower end of each sheet panel 22 is an angle bracket 26, and a bolt 27 extends from each anchor block 24 to a respective angle bracket 26. The bolt 27 may be tightened to draw the angle bracket toward the anchor block and apply a selected amount of tension to the sheet panel 22. Thus the sheet panels may be employed to apply a selected amount of compressive force to the arched wall of the structure.

The curvilinear configuration of the arched wall 11 may alternatively be parabolic, elliptical, hyperbolic, catenary, sinusoidal, or any other shape having proven structural strength. In addition, the plan format of buildings constructed in accordance with the invention may include, in addition to the rectangular format shown, any polygonal or curvilinear configuration that is practical and esthetically pleasing.

Figure 4:
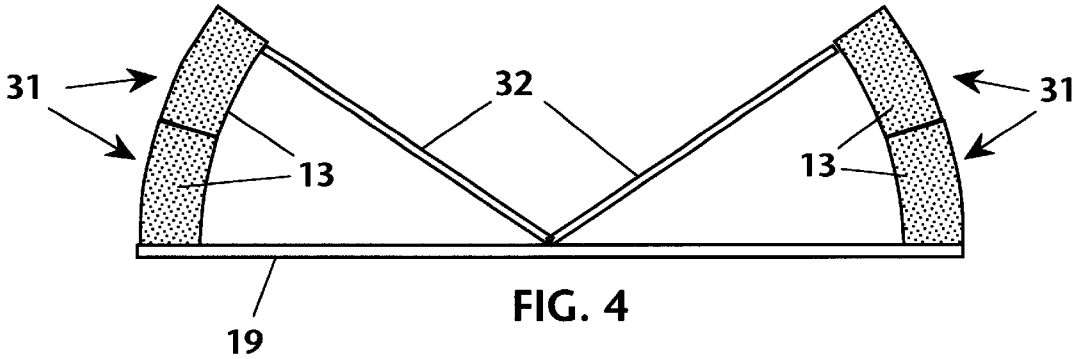
FIG. 4 is an end elevation depicting the initial steps of constructing the prestressed unitary building of the invention.
Figure 5:
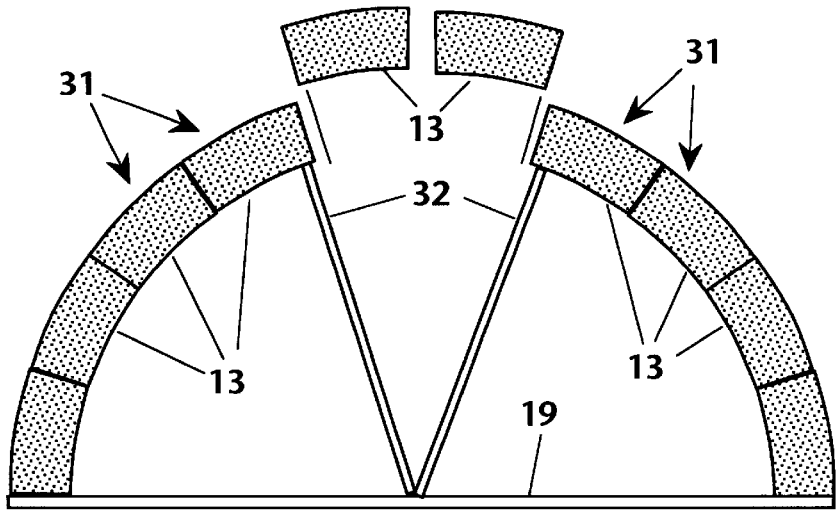
FIG. 5 is an end elevation as in FIG. 4, depicting the completion of the arched wall of the prestressed unitary building of the invention.

In a further aspect, the invention includes a method for constructing a building that incorporates the structural features described above. With regard to FIG. 4, construction begins with the creation of a floor surface 19, and may include footings 17 extending longitudinally along laterally opposed sides thereof, as described previously. A plurality of blocks 13 of lightweight cellular material are provided, each block constructed as described above. A course 31 of blocks are placed along each longitudinal edge of the floor 19, and secured in place with adhesive or the like. A second course of blocks is placed atop each first course and adhered thereto to begin the formation of the arched wall 12. Temporary bracing 32 may be extended from the floor 19 to the uppermost courses of blocks to support the courses as they are assembled. Thereafter, as shown in FIG. 5, further courses 31 are added to extend the wall 12 from each side, until the final cap blocks are placed to complete the arch configuration, at which time the temporary bracing may be removed. Construction may proceed rapidly, due to the fact that the blocks are large but lightweight and easily manipulated by a single individual.

Figure 9:
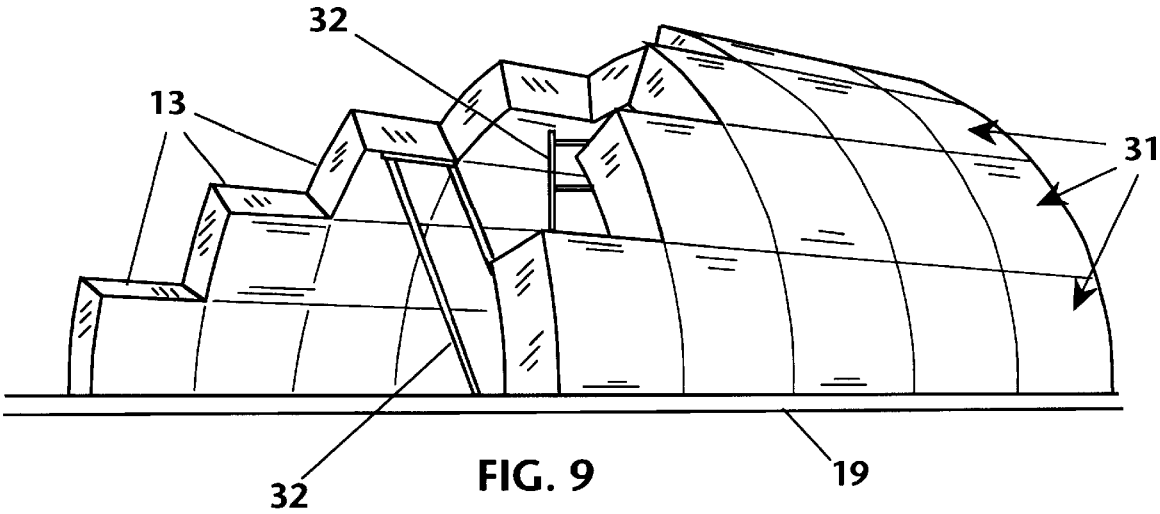
FIG. 9 is a perspective view depicting the prestressed unitary building of the invention during construction.
Figure 10:
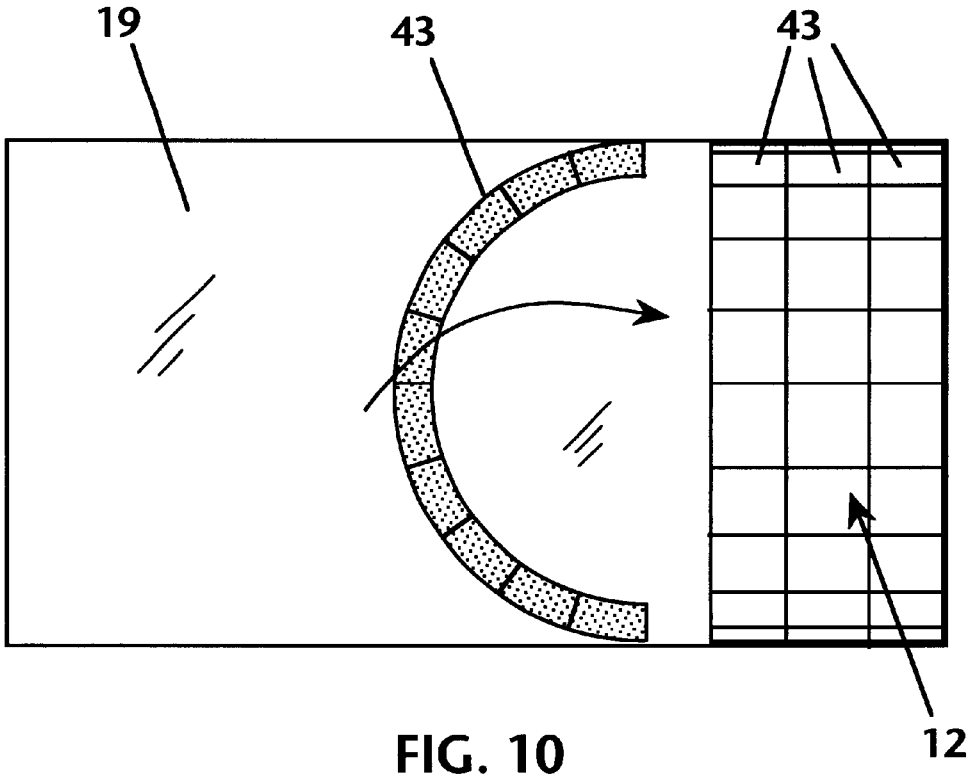
FIG. 10 is a plan view depicting an alternative method for constructing the building of the invention.
Figure 11:
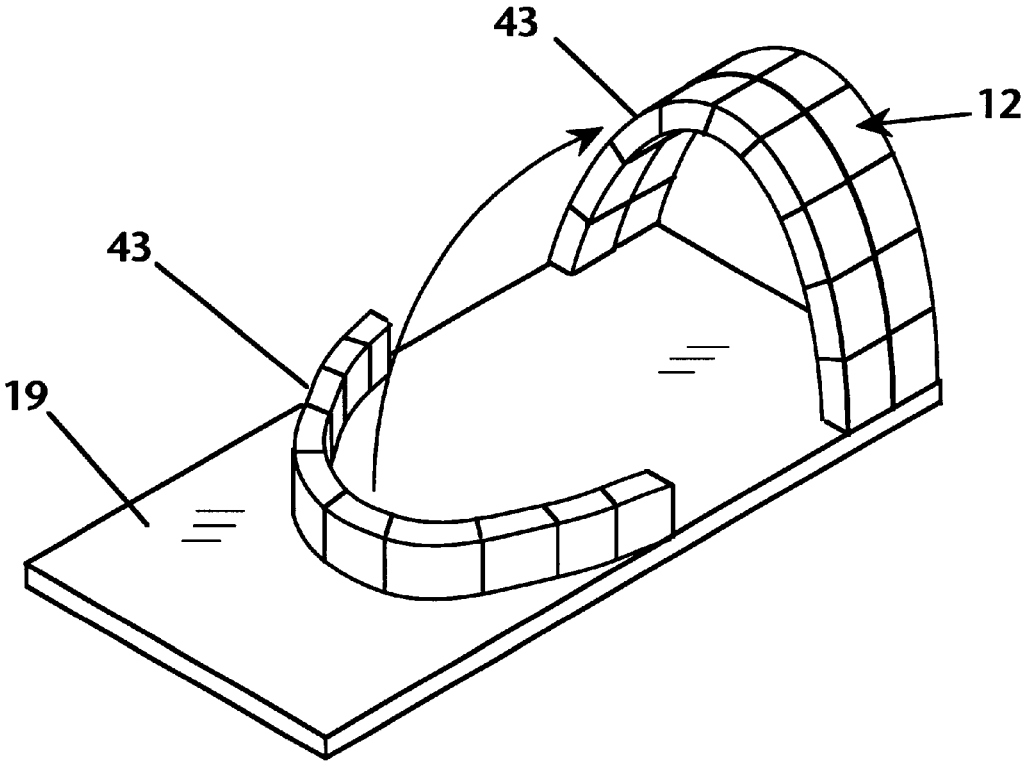
FIG. 11 is a perspective view depicting the alternative method for construction shown in FIG. 10.

As shown in FIG. 9, the construction may proceed as shown in FIG. 9, wherein the blocks 13 are stacked vertically to complete portions of the arched wall without observing a strict course-by-course regimen. This approach may be preferable in making more efficient use of a smaller amount of temporary bracing. In a further technique, shown in FIGS. 10 and 11, the blocks may be assembled transversely to form an individual arch 43 comprised of one row of blocks 13 laying in a horizontal plane, preferably on the floor surface 19. That arch may be tilted up to comprise one incremental section of the arched wall 12, and the process may be reiterated to add incremental sections in abutting, adhered relationship, until the entire arched wall is completed. The light weight of the blocks 13 and each completed arch 43 permits tilting up each arch 43 without undue effort. The technique of FIGS. 10 and 11 may be preferable, in that is requires no temporary supports and is accomplished rapidly.

After the arched wall 12 is completed, the outer skin 18 is placed over the outer surface of the arched wall, and tensioned to apply radial inward compression to the arched wall, as shown in FIG. 6. The outer skin may comprise a single tensile web or membrane; however, it may be more convenient to provide a plurality of flexible sheet panels 22, as described previously, and install the outer skin 18 in an incremental process by proceeding from one end of the arched wall and placing consecutive, adjacent panels 22 over the arched wall. The panels 22 may be overlapped and sealed within the each overlapping joint to form a weatherproof layer to protect the arched wall and the interior of the building. Thereafter the panels may be placed in tension to compress the arched wall, by use of the anchor assembly shown in FIG. 3 or any other practical tensioning mechanism.

Figure 7:
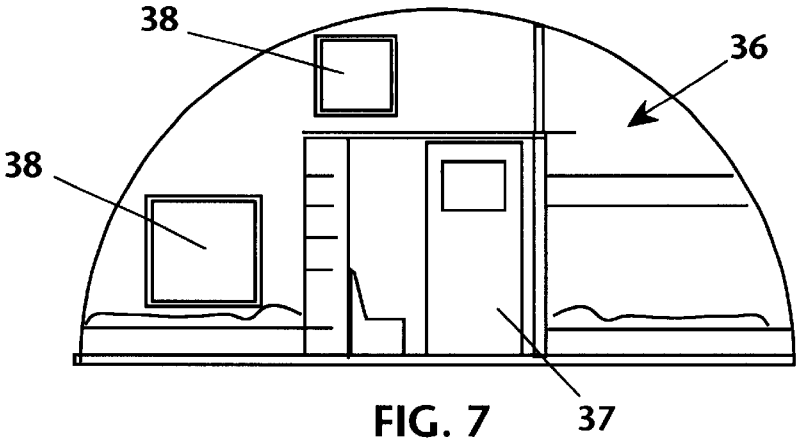
FIG. 7 is an end elevation depicting placement of interior walls with respect to an entry door and windows of the prestressed unitary building of the invention.
Figure 8:
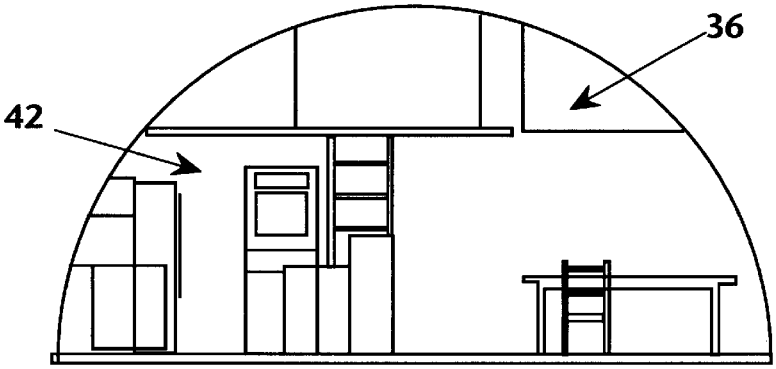
FIG. 8 is an end elevation depicting placement of interior furnishings in the prestressed unitary building of the invention.

Thereafter, end walls 36 (FIGS. 1, 7 and 8) may be installed at the opposed open ends of the arched wall 12 to form an enclosed interior space. The end walls (and, indeed, the floor 19) may be formed of structural insulated panels, and may include doors 37, windows 38, vents, and other mechanical and architectural items common to home construction and other small building construction. Before or after the step of enclosure of the interior space, the building may be furnished with common domestic systems, such as a bathroom 39, sleeping area 41, kitchen 42 (see also FIGS. 7 and 8), electrical, lighting, plumbing, and HVAC systems, and other typical amenities.

Although the method and structure of the invention includes footings typical of traditional construction, it may be noted that such footings are not necessary, given the fact that the arched wall 12 and outer skin 18 are much lighter than traditionally constructed walls and roof. Thus the anchors for the tensioning assemblies of the outer skin may be placed in the ground or secured beneath the edges of the floor panel 19.

The method and structure of the invention provide a synergistic assembly that takes maximum advantage of the materials used and the labor employed. That is, the cellular blocks comprise not only structural elements of the arched wall, but also substantial insulation for thermal and acoustic purposes. Likewise, the outer skin flexible panel strips comprise not only a weatherproof exterior, but also a structural element for placing the arched wall under permanent compression to substantially increase its strength. In addition, the footings support the arched wall and also provide tensioning anchors for the exterior strips, Thus the entire structure is a well-integrated assembly, resulting in a economical building that makes possible a comfortable, inexpensive domicile. Moreover, the structure may be premanufactured and sold as a kit, and may be assembled in do-it-yourself fashion without the use of skilled labor.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A building construction, including:

an arched wall having an upwardly convex curvature and a sheltered space defined thereunder, said arched wall including opposed, lower edge portions;

said arched wall being comprised of a plurality of blocks formed of a lightweight rigid cellular material having compression strength;

each of said plurality of blocks subtending a similar angular increment of said convex curvature and all being substantially similar in configuration;

means for adhering said blocks in abutting relationship to form said arched wall;

said arched wall having a curved outer surface extending substantially continuously between said opposed lower edge portions;

an outer skin layer secured to and impinging on substantially all of said continuous curved outer surface of said arched wall; and, means for applying tension to said outer skin layer to cause said outer skin layer to apply compression to substantially all of said continuous curved outer surface and strengthen said arched wall, said compression directed generally normally inwardly of said outer surface of said arched wall.

2. The building construction of claim 1, wherein said means for applying tension includes at least one anchor, and at least one tensioning assembly extending from said at least one anchor to said outer skin layer.

3. The building construction of claim 2, wherein said outer skin layer includes a lower edge portion adjacent to said lower portion of said arched wall, and said at least one tensioning assembly is secured to said edge portion of said outer skin layer.

4. The building construction of claim 3, wherein said outer skin layer includes a plurality of tensile web members secured about said outer surface of said arched wall, and further including a plurality of tensioning members, each secured to one end of a respective tensile web member.

5. The building construction of claim 4, wherein said plurality of tensile web members are arrayed in generally parallel fashion with overlapping adjacent edges to form said continuous outer skin layer.

6. The building construction of claim 4, wherein said plurality of tensioning members includes a plurality of threaded bolts, each bolt secured to one of said anchors and engaging said one end of a respective tensile member.

7. The building construction of claim 1, wherein said convex curvature comprises a semi-cylindrical shape having a generally horizontal axis of symmetry, and said lower portions of said arched wall includes laterally opposed, longitudinally extending bottom courses of said blocks.

8. The building construction of claim 7, wherein said outer skin layer includes a plurality of tensile web members secured about said outer surface of said arched wall,, and further including a plurality of tensioning members, each secured to one end of a respective tensile web member.

9. The building construction of claim 7, wherein said plurality of tensile web members are arrayed in generally parallel fashion with overlapping adjacent edges to form said continuous outer skin layer, said tensile web members extending circumferentially and semi-cylindrically about said arched wall and disposed generally coaxially with said semi-cylindrical arched wall.

10. The building construction of claim 7, further including end walls secured to opposed open ends of said semi-circular arched wall to define an enclosed spaced therebetween.

11. The building construction of claim 1, further including means for supporting said opposed lower edge portions, including a pair of footing walls extending longitudinally subjacently to the bottom courses of said blocks.

12. The building construction of claim 11, further including a plurality of anchor blocks secured in said footing walls and spaced longitudinally therealong, each anchor block disposed adjacent to an end of a respective one of said tensile web members.

13. The building construction of claim 12, further including means for drawing together each end of the tensile web members to the respective adjacent anchor block.

14. A method for constructing a building, including the steps of:

providing a plurality of blocks formed of a lightweight rigid cellular material having compression strength, each of said plurality of blocks subtending a regular angular increment of a convex curvature and all being substantially similar in configuration;

joining said blocks to forman arched wall having said convex curvature and a sheltered space defined therewithin, said blocks being joined in a single row to form an incremental arch in substantially horizontal disposition, thereafter tilting said incremental arch upwardly to a vertical disposition, and reiterating construction and tilt-up of incremental arches, said incremental arches placed in abutting adjacent relationship and adhered together to construct said arched wall;

applying an outer skin layer to the outer surface of said arched wall to form a weatherproof covering; and, applying tension to said outer skin layer to draw said outer skin layer about said outer surface and apply compression to said arched wall, whereby the load-bearing strength of said arched wall is increased.

15. The method for constructing a building of claim 14, wherein said step of applying an outer skin layer includes the steps of providing a plurality of tensile web members, and extending said tensile web member about said outer surface of said arched wall in an array to cover said outer surface.

16. The method for constructing a building of claim 15, wherein said tensile web members are installed in adjacent, parallel, abutting relationship.

17. The method for constructing a building of claim 15, wherein said step of applying tension to said outer skin includes providing a plurality of anchors adjacent to lower edge portions of the arched wall, and securing each end of each tensile web member to one of said anchors, and applying tension between each anchor and the respective end of a tensile web member.

18. The method for constructing a building of claim 17, further including the step of providing a footing wall to support said lower edge portions of the arched wall, and securing said anchors in said footing wall.

* * * * *